US005321390A

United States Patent [19]

Yuen

[11] Patent Number: 5,321,390

[45] Date of Patent: Jun. 14, 1994

[54] SENSOR SWITCH

[75] Inventor: John S. K. Yuen, Kowloon, Hong Kong

[73] Assignee: John Manufacturing Limited, Kowloon, Hong Kong

[21] Appl. No.: 952,591

[22] Filed: Sep. 28, 1992

[30] Foreign Application Priority Data

Oct. 16, 1991 [GB] United Kingdom ..... 9122002

[51] Int. Cl.[5] ..... G08B 13/14

[52] U.S. Cl. ..... 340/566; 340/571

[58] Field of Search ..... 340/566, 571

[56] References Cited

U.S. PATENT DOCUMENTS

| | | | |
|---|---|---|---|
| 3,745,551 | 7/1973 | Smith | 340/546 |
| 4,030,087 | 6/1977 | Ritchie et al. | 340/571 |
| 4,479,114 | 10/1984 | Yamamoto | 340/566 |
| 4,772,879 | 9/1988 | Hein | 340/571 |
| 5,027,105 | 6/1991 | Dailey et al. | 340/571 |
| 5,153,566 | 10/1992 | Yun | 340/566 |
| 5,235,321 | 8/1993 | Rowan et al. | 340/571 |

FOREIGN PATENT DOCUMENTS

| | | |
|---|---|---|
| 177982 | 1/1984 | European Pat. Off. . |
| 390132 | 6/1931 | United Kingdom . |
| 1213168 | 9/1967 | United Kingdom . |
| 1512343 | 2/1976 | United Kingdom . |
| 1539144 | 3/1977 | United Kingdom . |
| 2000377 | 6/1978 | United Kingdom . |
| 2058460 | 8/1980 | United Kingdom . |
| 2083706 | 8/1981 | United Kingdom . |
| 2181587 | 10/1985 | United Kingdom . |
| 2183876 | 12/1985 | United Kingdom . |

*Primary Examiner*—Glen Swann

*Attorney, Agent, or Firm*—Fay, Sharpe, Beall, Fagan, Minnich & McKee

[57] ABSTRACT

In a portable device sensitive to a change in movement a switch inside the device has a movable slug which increases the electrical resistance in an electrical circuit when the device is disturbed. Such increase in resistance in the electrical circuit unbalances two inputs of a Schmitt trigger to cause an output of the Schmitt trigger to switch a switching transistor to cause an oscillator to drive an output transducer to give an alarm. A feedback loop limits the period for which the alarm is given and a delay circuit prevents an alarm being given when the device is initially energized and before the two inputs of the Schmitt trigger are balanced.

20 Claims, 3 Drawing Sheets

SENSOR SWITCH

FIELD OF THE INVENTION

This invention relates to a portable device including a sensor switch sensitive to a change in movement, such as a portable device for providing an alert signal due to a disturbance caused by an intruder or a thief.

BACKGROUND OF THE INVENTION

Many buildings are fitted with alarm systems that sense the presence of intruders through various types of sensor switches. Simple sensor switches comprise a make-or-break switch connected to, for instance, a door or window, in a building. When an intruder opens the door or the window, contact between the make-or-break switch is broken and this causes an alarm to sound. Unfortunately, this type of security system requires many wires to be run around the building between the windows and the doors to the alarm and also, the alarm only sounds after the door or window has been broken into. More elaborate security systems are available which employ acoustic detectors as sensor switches. The acoustic detector detects sound waves generated within the room. If an intruder enters the room, the detector senses a frequency shift in the sound waves received due to the Doppler effect and when a frequency shift is detected, the acoustic detector causes an alarm to sound. Similar systems are available which employ infra-red detectors rather than acoustic detectors. These systems suffer from the disadvantages that they are relatively complex, and again are only activated after an intruder has entered the room.

Electronic devices have been proposed that to some extent overcome the above mentioned problems in that they cause an alarm to sound before a-n intruder has entered the room. A portable electronic device which can sense an intruder attempting to open a door, before the door is actually opened, has been proposed. This device comprises a loop shaped antenna which is placed onto a doorknob of the door and an electronic circuit connected to the antenna sensitive to changes in the circuit formed by the antenna due to capacitive coupling between the antenna and objects in contact with the doorknob. When an intruder attempts to turn the doorknob, the electronic circuit detects a change in capacitive coupling and causes an alarm to sound before the door is opened. Unfortunately, this device is still relatively complex and in order that it operates reliably the device must be securely mounted to the door by fastening the antenna tightly around the doorknob or fixing it to the doorknob with velcro or a suction cup. Thus, although this device is portable, it is really only suitable as a security device against potential intruders to a room.

It would be desirable to have a device that is simple in construction and provides a reliable alarm signal when the presence of a potential intruder is detected. Also, such a device would ideally provide a truly portable alarm which could be used as security against theft of objects outside of rooms, such as baggage left on a beach or goods temporarily left in a shop, for instance.

SUMMARY OF THE INVENTION

According to the invention there is provided a portable device sensitive to a change in movement comprising a power supply, a sensor switch and electronic switching means responsive to the sensor switch to activate an output transducer, in which:

the electronic sensing means is responsive to one of two resistance states of the sensor switch such that, when the device is at rest, the sensor switch provides a low resistance to current from the power supply and the electronic switching means does not activate the output transducer and, upon the device being disturbed from rest, the sensor switch is changed so as to provide an increased resistance to current and the electronic switching means is responsive thereto to activate the output transducer;

the electronic switching means includes a Schmitt trigger having an output connected to a switching transistor to activate the output transducer;

the sensor switch is connected to a first input of the Schmitt trigger;

when the device is at rest the low resistance of the sensor switch causes the output of the Schmitt trigger to switch the switching transistor into a state in which the output transducer is not activated and when the device is disturbed the increased resistance of the sensor switch causes the output of the Schmitt trigger to switch the switching transistor to a state in which the output transducer is activated; and the output of the switching transistor is connected to the first input of the Schmitt trigger to provide feedback so that, once the Schmitt trigger has switched the switching transistor into a state in which the output transducer is activated, that state is maintained even if the sensor switch again becomes a low resistance.

As such a portable device is only sensitive to changes in movement it can, for instance, be left in a bag containing possessions that need security against theft and will not be activated in response to the presence of people nearby unless they actually move the bag or disturb the bag in such a way as to move the device. The device is equally suited to being hung from a doorknob within a room, such as a hotel room, and can sense the presence of an intruder attempting to open the door because of the vibrations created thereby moving the device.

Preferably, the output transducer of such a device is an alarm which produces a loud audio signal when the device is disturbed from rest.

Only the slightest movement of the device will trigger the alarm and the alarm sound is maintained even if the device immediately comes to rest again.

Advantageously, the Schmitt trigger has a second input and a capacitor is connected to the second input, the capacitor normally being charged to hold the second input at a fixed logical level, and to the output of the Schmitt trigger by a resistor, such that the output level of the Schmitt trigger normally prevents discharge of the capacitor but, when the device is disturbed and the output level changes to switch the switching transistor, the capacitor can discharge through the resistor so that, when the capacitor is substantially discharged, the logical level at the second input of the Schmitt trigger changes and the output of the Schmitt trigger thereby resumes a logical level whereby the switching transistor is switched to a state in which the output transducer is not activated. Such a two input Schmitt trigger device can reset itself so that the alarm is not continuously sounded and the power supply thereby unnecessarily drained.

Preferably, the time constant formed from the resistor and the capacitor is about 20 seconds so that the output transducer can be activated for 20 seconds after the device is disturbed. However, if the device is fitted with a user operable on/off switch to set the alarm, manual operation of the on/off switch can disable the alarm before the 20 second period has elapsed.

Advantageously, the Schmitt trigger's second input is connected to the positive terminal of the power supply by a second resistor, and a second capacitor is connected between the second resistor and the second input to the negative terminal of the power supply and the second capacitor is not immediately charged when the power supply is turned on so that the output of the Schmitt trigger is not immediately affected by the position of the sensor switch. The device can therefore be set by a user and the alarm will not immediately sound despite the fact that the user moves the device in setting it.

Preferably, the first mentioned capacitor is charged by the output of the Schmitt trigger through a third resistor and a diode in which the time constant of the capacitor and the third resistor is less than the time constant set by the second capacitor and second resistor. As the capacitor charges fairly quickly, it ensures that the switching transistor is prevented from activating the alarm.

Preferably, the second resistor and the second capacitor set a time constant of about 10 seconds so the device is not sensitive to a change in movement for up to 10 seconds after the power supply is turned on, an input of a second Schmitt trigger is connected to the second capacitor and the output of the second Schmitt trigger is connected to an LED so that the LED is activated during the 10 seconds during which the second capacitor is charging. The device can therefore be moved about for up to 10 seconds after the power supply has been switched on and the device thereby set. This is ample time for the device to be mounted, for instance, on a door handle, or tucked away inside a bag. The illuminated LED indicates to the user that the alarm will not go of f but, once the LED has gone out, if the user touches the device the alarm will sound, unless the user turns off the power supply.

Such a device can be powered by a standard 9 volt battery cell which is relatively light and easily available.

A portable device, such as a portable security alarm, including a sensor switch sensitive to a change in movement is preferably light, compact and durable. Therefore, by necessity the sensor switch must also be light, compact and durable. It should be able to withstand being moved around and should be reliably resettable. Ideally, such a sensor switch should comprise a minimum number of parts, be cheap to produce and easy to construct. Such a switch should include few moving parts and any moving parts that are included should not be susceptible to wear. Despite this however, the moving parts should be highly responsive to a change in movement so that a sensitive sensor switch can be formed.

Preferably the sensor switch comprises two spaced apart electrical contacts, each with a recess therein and a conductive slug which rests in the recesses when the sensor switch is at rest so as to make a continuous electrically conductive path between the electrical contacts such that, when the sensor switch is subjected to a change in movement, the slug will leave the resting position so that the conductive path between the electrical contacts will be broken and when the sensor switch ceases movement and the slug again rests in the recesses the conductive path will be resumed, and the electrical contacts are supported and insulated from one another by an insulating member in the form of a length of tubing of resilient insulating material, such as plastics, which engages over shoulder portions on the electrical contacts.

Such a sensor switch can be very simple, rugged in construction and can be formed from only three basic parts.

Advantagously, the chamber is cylindrical in shape and the electrical contacts cap the open ends of the cylindrical chamber.

Advantageously, the two recesses oppose each other and define a volume larger than that taken up by the slug, and the slug is generally elongate and resides in that volume. The caps and slug can be formed out of any conductive material such as, for instance, copper.

Preferably, each contact includes a resilient filament mount by which the sensor switch can be mounted, on an object which can move. A sensor switch mounted on resilient filament mounts is highly sensitive to movement because vibrations are multiplied along the length of the filament.

Preferably, each resilient filament forms a conductive lead for passing electric current to each contact. The resilient filaments thereby form both part of the sensing mechanism, and electrically conductive means by which current is passed through the sensing switch.

A portable device incorporating such a sensor switch can be made extremely compactly as the chamber of the sensor switch can be made to a size approximately 10 mm long and 8 mm wide. For most applications. the sensor switch can be connected directly to a conductive mounting board and the sensor need not be mounted on resilient filaments. A resilient filament mounting need only be employed to construct the most sensitive devices.

DETAILED DESCRIPTION OF THE EMBODIMENT

Figure 1:
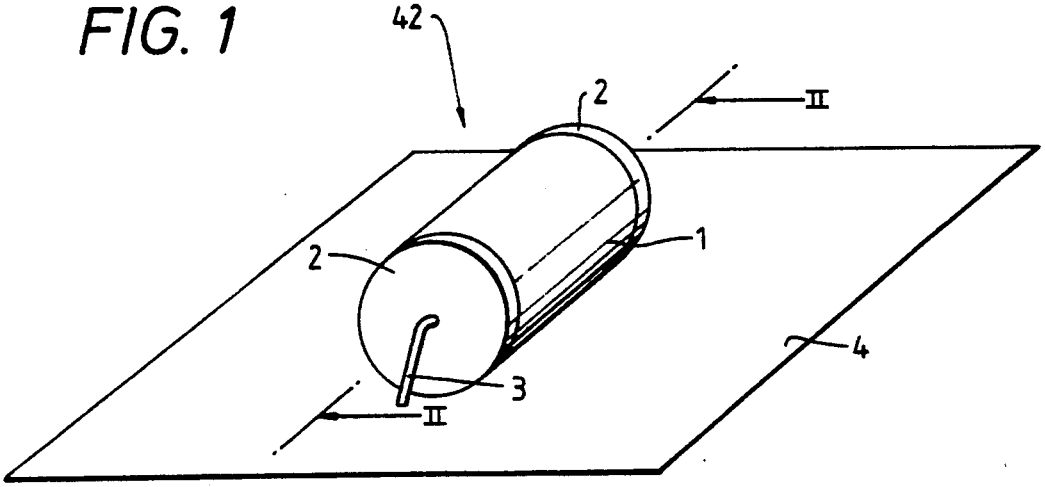
FIG. 1 shows a perspective view of a sensor switch for use in a portable device sensitive to movement according to the invention.

FIG. 1 shows a perspective view of a sensor switch 42 sensitive to a change in movement and comprising a cylindrical-shaped chamber 1 made from tubing of plastics or other resilient insulating material. Electrically conducting caps plug the ends of the cylindrical chamber 1 and are held in place by compression forces created by the resilient tubing. The caps form electrical contacts 2 which can be connected to the positive and negative terminals of a power supply. As shown in FIG. 1, the sensor switch rests on a mounting board 4 and is electrically connected thereto by wires 3 soldered to each of the electrical contacts 2. The way electrical contact is made between the electrical contacts 2 to thereby make the switch can be understood more clearly by considering FIG. 2.

Figure 2:
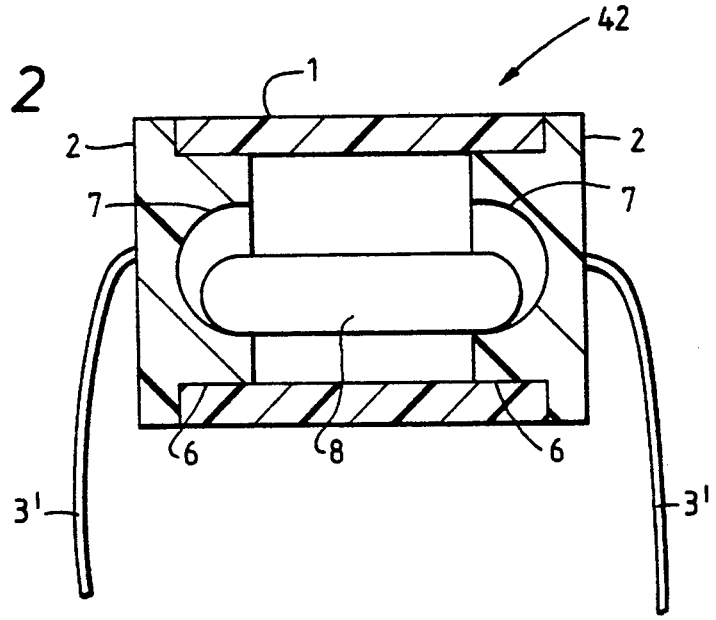
FIG. 2 shows a cross-section of the sensor switch taken on line II—II of FIG. 1.

As can be seen in FIG. 2, each electrical contact 2 is a cap which also plugs into an end of the chamber 1. A circular wall 6 runs close to the border of the inner face of each electrical contact 2 forming a shoulder that resides within the chamber 1. The resilient tubing of the chamber 1 tightly grips each circular wall 6 so that the electrical contacts 2 are securely fixed to the chamber 1. Inside each circular wall 6 is formed a recess 7. An elongate slug 8 made from a metal such as copper or another conductive material, resides within the chamber 1 and rests against the inner faces of the recesses 7- The slug 8 forms an electrical bridge between the two electrical contacts 2. When the sensor switch is disturbed, the slug 8 is lifted from contact with one or each of the recesses 7 and the electrical bridge between the two contacts 2 is thereby broken until the slug 8 again makes contact with both recesses 7. The chamber 1, electrical contacts 2 and slug 8 thereby form a sensor switch sensitive to changes in movement. As can be seen from FIG. 2 the slug 8 is trapped within a shaded volume formed by the recesses 7 and the free space therebetween. Although the slug 8 can move within this volume, and so a bridge between the two electrical contacts 2 can be made and broken, the size and shape of the slug 8 is such that no matter in what rest position the sensor switch resides, electrical contact is always made between the two contacts 2.

In FIG. 2, hairlike wires 3' are soldered onto the outer faces of the electrical contacts 2. The free ends of the wires 3 can be mounted on a mounting board for instance and supplied with current from the power source. Sensitivity of the sensor switch to movements is increased if long hairlike wires 3' are employed. For instance, in one embodiment of the invention the sensor switch has a length of 10 mm and a width of 8 mm, and forms a highly sensitive switch with hairlike wires of length 15 mm. However, for most purposes a sensitive sensor switch can be formed without the need of long hairlike wires 3' to connect it to a power supply.

Figure 3:
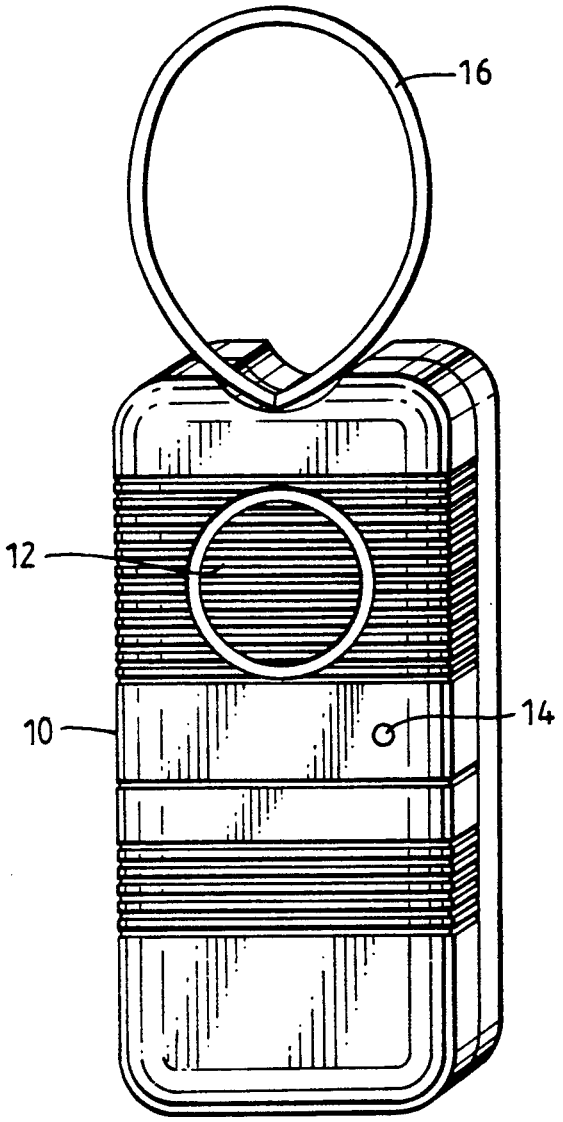
FIG. 3 shows a perspective view of a portable device sensitive to a change in movement according to the invention.

FIG. 3 shows a portable device sensitive to a change in movement according to an embodiment of the invention. The device comprises a housing 10, audio transducer 12, light emitting diode (LED) 14, pull-cord 16 and associated circuitry (see FIG. 4) The device is powered by an internal 9 volt battery cell 18 (FIG. 4) and so is easily portable. The device is turned "on" by pulling the pull-cord 16 upwards. This sets a switch 20 inside the housing 10 to an "on" position and 9 volts is placed across the electronic circuitry by the battery cell 18. The LED 14 lights indicating that the device has been activated but that an alarm has not yet been set. As the pull-cord 16 is in the shape of a loop it can be hooked around fixed structures such as doorknobs or handles. After about 10 seconds the LED 14 goes out. This indicates that the device is set and that should the device be physically disturbed in any way the alarm will sound through activation of the audio transducer 12. If the device is mounted, for instance, on a doorknob by the pull-cord 16, then any attempt to move the doorknob by an intruder (or any other person) will be sensed by a sensor switch 42 within the device and the audio transducer 12 will sound.

Operation of the portable device shown in FIG. 3 can be described in greater detail with reference to the circuit diagram shown in FIG. 4. When the manual switch 20 is placed in the "on" position 9 volts is placed across the entire circuit by the battery cell 18. An electric current passes through a resistor 22 and begins to charge a capacitor 24. At first, point A on the circuit diagram is at a relatively low voltage so that the two inputs of a Schmitt trigger NAND gate 26 are at a logical low level. Therefore, the output of the Schmitt trigger NAND gate 26 is a logical high and so an LED 28 is lit. The time constant formed by the resistor 22 and the capacitor 24 is approximately 10 seconds; after 10 seconds point A will be at a relatively high voltage and so the two inputs of the NAND gate 26 become a logical high and the output of the NAND gate 26 becomes a logical low so that the LED 28 goes out. Also, when the switch 20 is switched on a Schmitt trigger NAND gate 30 has a logical high output and charges a capacitor 32 via a resistor 34 and a diode 36. The output of the NAND gate 30 also passes to the base of a transistor 38 and the immediate high output from the NAND gate 30 to the base of the transistor 38 ensures that the collector-emitter path in the transistor 38 is cut off even though the emitter of the transistor 38 is connected to the positive of the battery cell 18. 9 volts from the battery cell 18 is also placed across a resistor 40 and the sensor switch 42. The sensor switch 42 is normally closed when the device is at rest and is then a relatively low resistance to the flow of electric current. However, should the device be moved, the sensor switch 42 becomes open and then represents a large resistance. Therefore, when the device is at rest, a point B on the circuit will be at a relatively low voltage, but when the device is moved and the sensor switch 42 is opened, point B goes to a relatively high voltage (approximately 8 volts). Point B is connected via a capacitor 41 and a diode 46 to an input 30*b* of the NAND gate 30. When the other input 30*a* of the NAND gate 30 is a logical high, the logical level of the input 30*b* is representative of the output state of the device. The output of the NAND gate 30 can become a logical low level only if both the inputs are high, that is the inputs 30*a* and 30*b* must both be high. The input 30*a* is held at approximately the same voltage as point A and therefore, as this is low during the first 10 seconds as the switch 20 is switched on, the NAND gate 30 is unaffected by changes iii the potential of point B caused by movement of the device. However, after 10 seconds, when the capacitor 24 is charged and point A is at a logical high level, the input terminal 30*a* also becomes a logical high and so the output of the NAND gate 30 will only remain a logical high so long as the sensor switch 42 is kept closed; that is the device is undisturbed. The capacitor 41 is relatively small and so the NAND gate 30 responds essentially instantaneously to changes in the potential at point B.

Thus, once the switch 20 has been set to the "on" position and the battery cell 18 has fully charged the capacitor 24 after about 10 seconds, the LED 28 goes out and the device is set and ready to be triggered by a movement causing a break of the sensor switch 42. If the switch 42 is broken and point B becomes a logical high, the output of the NAND gate 30 becomes a logical low and the potential at the base of the transistor 38 drops thereby allowing conduction between the emitter and conductor. A circuit point C, which was previously at a low voltage, becomes a relatively high voltage. An input of a Schmitt trigger NAND gate 44 and an input 46*a* of a Schmitt trigger NAND gate 46 both become a logical high. The other input of the NAND gate 44 is at a logical low and so the output of the NAND gate 44 is at first a logical high. However, the output of the NAND gate 44 is passed back into the input 44*b* via a resistor 48 so that the input 44*b* also becomes a logical high, and the output of the NAND gate 44 goes to a logical low level. The logical low level on the output of NAND gate 44 is again fed back into the input 44*b* and so oscillations in the output of the NAND gate 44 are set up. The time period of the oscillations is governed by the resistor 48 and a capacitor 50 and has a value of around 1 Hz. Oscillations in the outputs of the NAND gate 46 are also set up as the output of the NAND gate 46 is fed back into its other input 46*b* via a resistor 52. The time period of oscillations in the output of the NAND gate 46 is set by the resistor 52 and a capacitor 54. The oscillations of the output of the NAND gate 46 has a frequency of around 2.5 KHz which is in the audio-frequency range. The NAND gates 44 and 46 form a pulsed oscillator for an audi-frequency transducer 56 as the output of the NAND gate 44 is passed to the input 46*b* of the NAND gate 46 so that the audio-frequency oscillations from the NAND gate 46 are pulsed on and off by the NAND gate 44. The oscillating output of the NAND gate 46 is applied to the base of a drive transistor 58. The base of the drive transistor 58 is normally at a high voltage, so that even though the emitter of the drive transistor 58 is connected directly to the positive of the battery cell 18, current is not passed between the collector and the emitter. However, once the output of the NAND gate 46 begins to oscillate between a logical low and a logical high level, the potential at the base of the drive transistor 58 intermittently drops and pulsed audio-frequency current passes between the emitter and the collector from the battery cell 18 to a matched impedance transformer 60 associated with the audio transducer 56 and so an alarm is sounded.

A feedback loop also exists between the output of the NAND gate 30 and its input 30*b* by the switching transistor 38 and a diode 62. Therefore, even if the potential at point B immediately drops to a low level because contact is made again in the sensor switch 42 after it has been opened by disturbance of the device, the output of the NAND gate 30 remains low and the potential at point C remains high. The audio-frequency transducer 56 therefore continues to sound once the sensor switch 42 has been disturbed even if the device is then laid to rest. The audio-frequency transducer 56 can be turned "off" simply by pulling the switch 20 into the "off" position through the pull-cord 16. However, in situations where the switch 20 is not actuated, the audio transducer 56 will not sound forever. In order to preserve the life of the battery cell 18, the device is automatically reset after a period of about 20 seconds. This is because, once the output of the NAND gate 30 drops to a logical low level, the capacitor 32 begins to discharge through a relatively large resistor 34. When the charge on the capacitor 32 reaches a low level, the potential at input 30*a* of the NAND gate 30 drops to a logical low level and so the output again becomes high. The high output of the NAND gate 30 causes the base of the switching transistor 38 to switch the switching transistor "off" so that point C returns to a logically low level and a logical low is passed to the input terminal 30*b* of the NAND gate 30. The high output of the NAND gate 30 quickly recharges the capacitor 32 through the resistor 34 and the diode 36 and the input 30*a* returns to a logical high level.

The potential at the input 30*a* of NAND gate 30 is normally held at a high level through the combined action of the potential on the capacitor 24 across a diode 25 and the potential on the capacitor 32 across a diode 27. The diodes 25 and 27 effectively form an "AND" gate for the input 30*a* of the NAND gate 30.

The portable device sensitive to a change in movement hereinbefore described comprises few components and is easy to construct. The four Schmitt trigger NAND gates, 26, 30, 44 and 46, can be formed on a single integrated circuit, for instance, IC TC4093BP produced by Toshiba. All of the diodes are of the type 1N4148 and the two transistors are of the type 2SA733P. The values of other standard components are as indicated in FIG. 4. The sensor switch 42 may comprise a sensor switch according to the first aspect of the invention as described above.

There has been described and illustrated a sensor switch sensitive to a change in movement and a portable device sensitive to a change in movement which may include the sensor switch. It will be understood that many variations on the shape of the sensor switch illustrated in FIGS. 1 and 2 could work equally well. For instance, the chamber 1 need not necessarily define a right circular cylindrical shape; a chamber in the form of a square cylindroid, a box or practically any other shape could be employed provided that a slug can be relatively freely contained by two inner conducting surfaces of the device so that it bridges the gap between the two conducting surfaces when the sensor switch is at rest in any position but can leave contact with at least one of the conducting surfaces, so that the contact is broken, when the sensor switch is moved.

Figure 4:
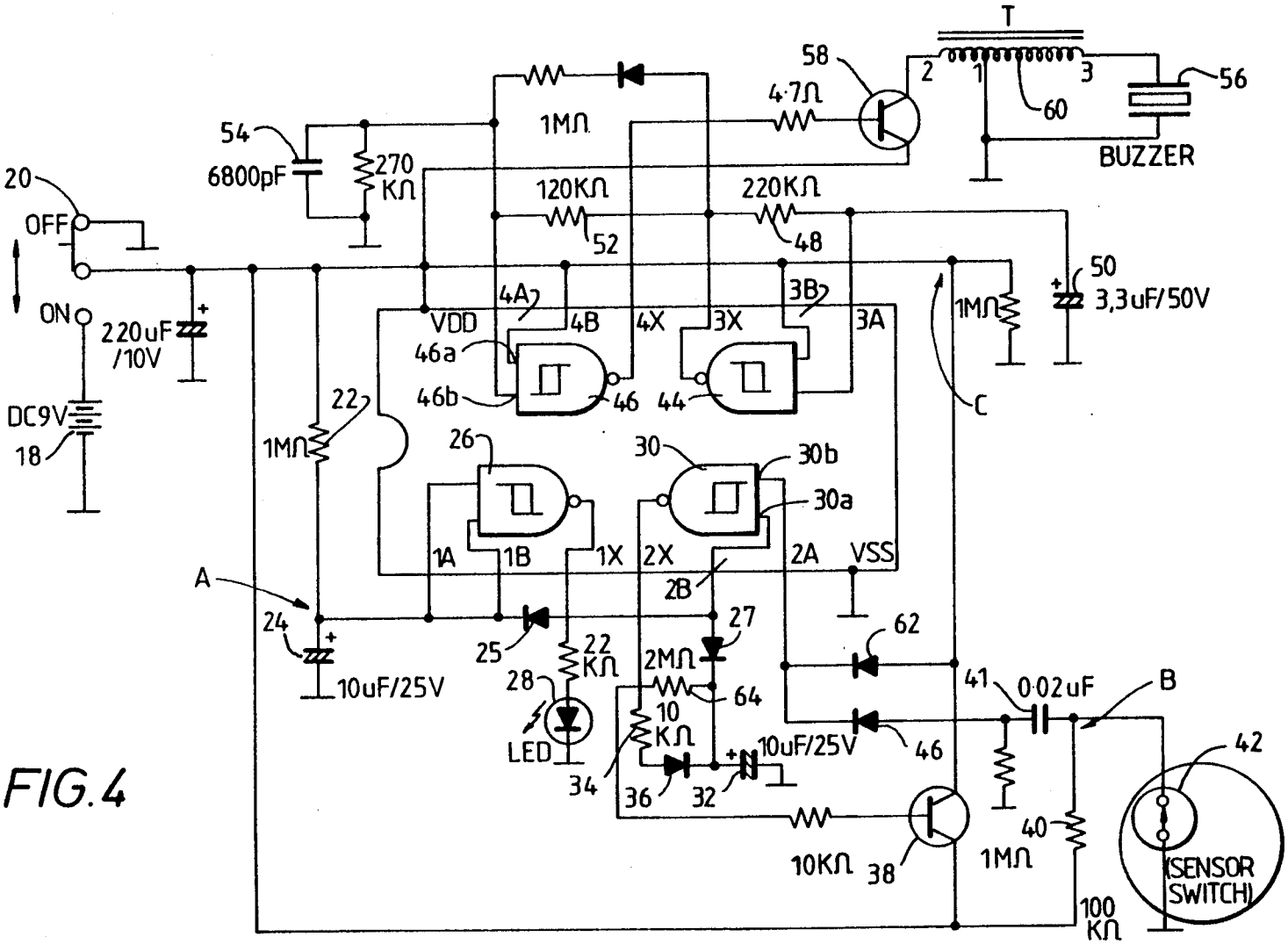
FIG. 4 shows a circuit diagram of one embodiment of a portable device sensitive to a change in movement according to the invention.

Also, numerous features of the portable device sensitive to a change in movement as described and illustrated with respect to FIGS. 3 and 4 could be varied or are inessential. It is important that the portable device merely includes a power supply and an electronic switching means activated in response to a movement sensor switch to produce an alert, for instance, by an audio alarm or by an alerting light. The specifically described electronic switching means included an integrated circuit comprising four Schmitt trigger NAND gates. However, other gating circuit systems could be employed such as AND gates, for instance.

While a preferred embodiment has been set forth along with modifications and variations to show specific advantageous details of the present invention, further embodiments, modifications and variations are contemplated within the broader aspects of the present invention, all as set forth by the spirit and scope of the following claims.

What is claimed is:

1. A portable device sensitive to a change in movement comprising a power supply, a sensor switch having two resistance states comprising a low resistance state and a higher resistance state, an output transducer and electronic switching means responsive to the sensor switch to activate said output transducer, in which:

said electronic switching means is responsive to said low resistance state of said two resistance states of said sensor switch such that, when said device is at rest, said sensor switch provides said low resistance state to current from said power supply and said electronic switching means does not activate said output transducer and, upon said device being disturbed from rest, said sensor switch is changed so as to provide said higher resistance state to the current and said electronic switching means is responsive thereto to activate said output transducer;

said electronic switching means includes a switching transistor and a Schmitt trigger having an output connected to the switching transistor to activate said output transducer;

said sensor switch is connected to a first input of the Schmitt trigger;

when the device is at rest said low resistance state of the sensor switch causes the output of said Schmitt trigger to switch said switching transistor into a state in which said output transducer is not activated and when said device is disturbed said higher resistance state of said sensor switch causes the output of said Schmitt trigger to switch said switching transistor to a state in which said output transducer is activated; and said switching transistor having an output connected to said first input of said Schmitt trigger to provide feedback so that, once said Schmitt trigger has switched said switching transistor into a state in which said output transducer is activated, that state is maintained even if said sensor switch again becomes said low resistance state.

2. A device as claimed in claim 1, in which said Schmitt trigger has a second input; a resistor; and a capacitor connected to said second input (said capacitor normally being charged to hold said second input at a fixed logical level) and to the output of said Schmitt trigger by the resistor, such that the output level of said Schmitt trigger normally prevents discharge of said capacitor but, when the device is disturbed and the output level changes to switch said switching transistor, said capacitor can discharge through said resistor so that, when said capacitor is substantially discharged, the logical level at said second input of said Schmitt trigger changes and the output of said Schmitt trigger thereby resumes a logical level whereby said switching transistor is switched to a state in which said output transducer is not activated.

3. A device according to claim 2, wherein said resistor and said capacitor form a time constant that is about 20 seconds so that said output transducers can be actuated from 20 seconds after said device is disturbed.

4. A device as claimed in claim 3, wherein said output of the Schmitt trigger is connected to the base of said switching transistor, said power supply is connected to the emitter thereof and the collector thereof is connected to a drive transistor which is connected to and drives said output transducer.

5. A device as claimed in claim 2, wherein said Schmitt trigger is a Schmitt trigger NAND gate and an output of said NAND gate is normally a logical high which holds said switching transistor in a state in which said output transducer is not activated, said first input connected to said sensor switch is normally held at a logical low level and said second input is held at a logical high level by said capacitor; and when said device is disturbed, said sensor switch causes said first input of said NAND gate to be held at a logical high level so that the output of said NAND gate goes low and said switching transistor is caused to activate said output transducer, and said capacitor, which is normally prevented from discharging by the logical high output on the output of said NAND gate, discharged until the second input of the NAND gate becomes a logical low level and the output of the NAND gate reverts to a logical high level.

6. A device as claimed in claim 5, wherein said output of the Schmitt trigger is connected to the base of said switching transistor, said power supply is connected to the emitter thereof and the collector thereof is connected to a drive transistor which is connected to and drives said output transducer.

7. A device as claimed in claim 2, wherein said second input is connected to a second capacitor, a second resistor is connected between a positive terminal of the power supply and said second input, and said second capacitor is not immediately fully charged when the power supply is turned on so that the output of said Schmitt trigger is not immediately affected by the position of said sensor switch.

8. A device as claimed in claim 7, wherein said first-recited capacitor is charged by the output of the Schmitt trigger through a third resistor and a diode, a time constant of the first-recited capacitor and the third resistor being less than a time constant set by the second capacitor and the second resistor.

9. A device as claimed in claim 7, wherein said second resistor and said second capacitor set a time constant of about 10 seconds so the device is not sensitive to a change in movement for up to 10 seconds after said power supply is turned on.

10. A device as claimed in claim 9, including a second Schmitt trigger and an LED and wherein an input of said second Schmitt trigger is connected to said second capacitor and the output of the second Schmitt trigger is connected to said LED so that said LED is activated during the 10 seconds during which said second capacitor is charging.

11. A device as claimed in claim 2, wherein said output of the Schmitt trigger is connected to the base of said switching transistor, said power supply is connected to the emitter thereof and the collector thereof is connected to a drive transistor which is connected to and drives said output transducer.

12. A device as claimed in claim 1, wherein said output of the Schmitt trigger is connected to the base of said switching transistor, said power supply is connected to the emitter thereof and the collector thereof is connected to a drive transistor which is connected to and drives said output transducer.

13. A device as claimed in claim 12, wherein said output transducer is an audio transducer; and including, between the collector of said switching transistor and said drive transistor, oscillator means activated in response to the level of said collector of said switching transistor to produce an oscillating audio frequency signal to control said drive transistor which drives said output transducer.

14. A device as claimed in claim 1, wherein said power supply is a 9 volt cell.

15. A device as claimed in claim 1, wherein:

said sensor switch comprises two spaced apart electrical contacts, each with a recess therein and a conductive slug which rests in the recesses when said sensor switch is at rest so as to make a continuous electrically conductive path between said electrical contacts such that, when said sensor switch is subjected to a change in movement, the slug will leave the resting position so that the conductive path between the electrical contacts will be broken and when said sensor switch ceases movement and said slug again rests in the recesses the conductive path will be resumed; and said electrical contacts are supported and insulated from one another by an insulating member in the form of a length of tubing of resilient material which engages over shoulder portions of said electrical contacts.

16. A device as claimed in claim 15, wherein said two recesses oppose each other and define a chamber with a volume larger than that taken up by said slug, and said slug is generally elongate and resides in that volume.

17. A device as claimed in claim 16, wherein said chamber is approximately 10 mm long and 8 mm wide.

18. A device as claimed in claim 15, wherein each of said contacts includes a resilient filament by which said sensor switch can be mounted on an object which can move.

19. A device as claimed in claim 18, in which each resilient filament forms a conductive lead for passing electric current to said contacts.

20. A device as claimed in claim 18, wherein each said resilient filament is at last 15 mm long.

* * * * *